US005672454A

United States Patent [19]

Sasaki et al.

[11] Patent Number: 5,672,454

[45] Date of Patent: Sep. 30, 1997

[54] TONER CONTAINING PARTICULATE MAGNETIC MATERIALS

[75] Inventors: Mitsuhiro Sasaki; Koji Akiyama, both of Wakayama, Japan

[73] Assignee: Kao Corporation, Tokyo, Japan

[21] Appl. No.: 352,692

[22] Filed: Dec. 1, 1994

[30] Foreign Application Priority Data

Dec. 2, 1993 [JP] Japan ..... 5-339392

[51] Int. Cl.[6] ..... G03G 9/083

[52] U.S. Cl. ..... 430/106.6; 430/137

[58] Field of Search ..... 430/106, 106.6, 430/137

[56] References Cited

U.S. PATENT DOCUMENTS

| | | | |
|---|---|---|---|
| 3,558,492 | 1/1971 | Preskow | 430/106.6 |
| 4,133,774 | 1/1979 | Brynko et al. | 252/62.1 |
| 4,155,883 | 5/1979 | Oguchi et al. | 430/106.6 |

FOREIGN PATENT DOCUMENTS

| | | |
|---|---|---|
| 0 463412 | 1/1992 | European Pat. Off. . |
| 0595347 | 5/1994 | European Pat. Off. . |
| 0 615167 | 9/1994 | European Pat. Off. . |
| 0 642059 | 3/1995 | European Pat. Off. . |
| 2148523 | 5/1985 | United Kingdom . |

OTHER PUBLICATIONS

Patent Abstracts of Japan vol. 13, No. 377 (P–922) [3725], 22 Aug. 1989 & JP–A–01 131574 (Toppan) 24 May 1989.

Image Science and Technology, M. Ochiai et al., Oct. 4, 1993, pp. 33–36.

*Primary Examiner*—John Goodrow

*Attorney, Agent, or Firm*—Birch, Stewart, Kolasch & Birch, LLP

[57] ABSTRACT

A toner for developing an electrostatic latent image which includes at least particulate magnetic materials and a binder resin has no particulate magnetic materials on the surface of the toner. In the toner, wherein A and $b_{min}$ satisfy the relationship: $b_{min}/A>0.02$, where A represents an average particle diameter of the toner, and $b_{min}$ represents a minimum distance between a particulate magnetic material located at a position closest to the surface of the toner and the toner surface.

12 Claims, 4 Drawing Sheets

TONER CONTAINING PARTICULATE MAGNETIC MATERIALS

BACKGROUND OF THE INVENTION

1. Field of the Invention

The present invention relates to a toner for developing an electrostatic latent image which is formed in electrophotography, electrostatic printing, or electrostatic recording.

2. Discussion of the Related Art

At present, as various kinds of practically used dry-type developing methods in electrostatic copying, two-component developing methods using a toner and a carrier such as iron powders, magnetic one-component developing methods using a toner in which particulate magnetic materials are incorporated in the inner portion of the toner without using a carrier, and nonmagnetic one-component developing methods using a toner containing no particulate magnetic materials therein have been known.

In recent years, the equipment utilizing electrophotography has been widely used in the fields of printers and facsimiles besides conventional copy machines. Particularly in the small printers and facsimiles, since the copy device portions have to be miniaturized, the one-component developing methods are mainly used.

Specifically, the two-component developing methods differ from the one-component developing methods in that the weight of the developer is heavy because the carrier particles are contained therein. Further, in the two-component developing method, the toner concentration in the two-component developer has to be maintained at a given level, so that a device for detecting the toner concentration and automatically supplying a necessary amount of the toner is required, and thereby the overall developer device becomes larger and heavier. By contrast, in the one-component developing method, since such a device would not be necessary, the overall machine can be advantageously made smaller and lighter.

On the other hand, in various copy machines, high-speed printing and stability of forming images have always been in demand. Therefore, presently two-component developing methods are used as a main stream for speeded-up machines, such as medium-speed machines and high-speed machines.

In addition, the toner for two-component developers is colored with such coloring agents as carbon blacks, and other components contained in the toner comprise mainly polymers. Therefore, the toner particles are light, and there are no other forces than electrostatic forces to adhere the toner particles to the carrier particles, so that particularly in high-speed development, toner scattering is likely to take place, which in turn may cause in the long-term staining of optical lenses, table glass, and paper conveying portions. Thus, the stability of the forming images becomes poor. Therefore, a developer is now actually used wherein toner scattering is inhibited by making the toner heavy by incorporating particulate magnetic materials therein, and further by giving adhesion to the magnetic carrier particles not only with electrostatic forces but also with magnetic forces.

However, even though the above toner containing the particulate magnetic materials becomes increasingly important, its fixing ability is substantially poorer than the toners containing only a small amount of the particulate magnetic materials used for two-component developing methods because the above toner contains the particulate magnetic materials in an amount of 30 to 70% by weight. This problem has not yet been solved.

A method wherein the particulate magnetic materials, such as magnetite powder, can be well dispersed in the toner by using particulate magnetic materials subjected to a hydrophobic treatment by in situ method when preparing a magnetic toner by suspension polymerization is known (see M. Ochiai et al., "Final Program and Proceedings of The 9th International Congress on Advances in Non-Impact Printing Technologies/Japan Hardcopy '93," Pages 33–36, distributed on Oct. 4, 1993). However, in this method, since the purpose of this method is only to evenly disperse the particulate magnetic materials which are not easily dispersed in the toner and thereby are likely to aggregate on the toner surface, the particulate magnetic materials exist even in the peripheral portion of the toner. Therefore, it would not be possible to form a peripheral resin portion containing no particulate magnetic materials in the toner, so that the fixing strength may be undesirably lowered and the low-temperature fixing ability may become poor.

SUMMARY OF THE INVENTION

An object of the present invention is to provide a toner for developing an electrostatic latent image having good developing ability and transferring ability, so that high-quality images can be obtained, and also having excellent fixing ability.

As a result of intense research in view of the above problems, the present inventors have found that the above problems can be eliminated by using a toner in which particulate magnetic materials are incorporated only in a particular portion of the inner portion of the toner. The present invention has been completed based upon the finding.

Specifically, the present invention is concerned with a toner for developing an electrostatic latent image, comprising at least particulate magnetic materials and a binder resin, the toner having no particulate magnetic materials on the surface of the toner, wherein A and $b_{min}$ satisfy the relationship:

$$b_{min}/A>0.02,$$

where A represents an average particle diameter of the toner, and $b_{min}$ represents a minimum distance between a particulate magnetic material located at a position closest to the surface of the toner and the toner surface.

The toner for developing an electrostatic latent image of the present invention has excellent offset resistance, is fixable at a low temperature, and has excellent blocking resistance, so that clear images free from background contamination can be stably formed for a large amount of copying in the heat-and-pressure fixing method using a heat roller, etc.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

Figure 1:
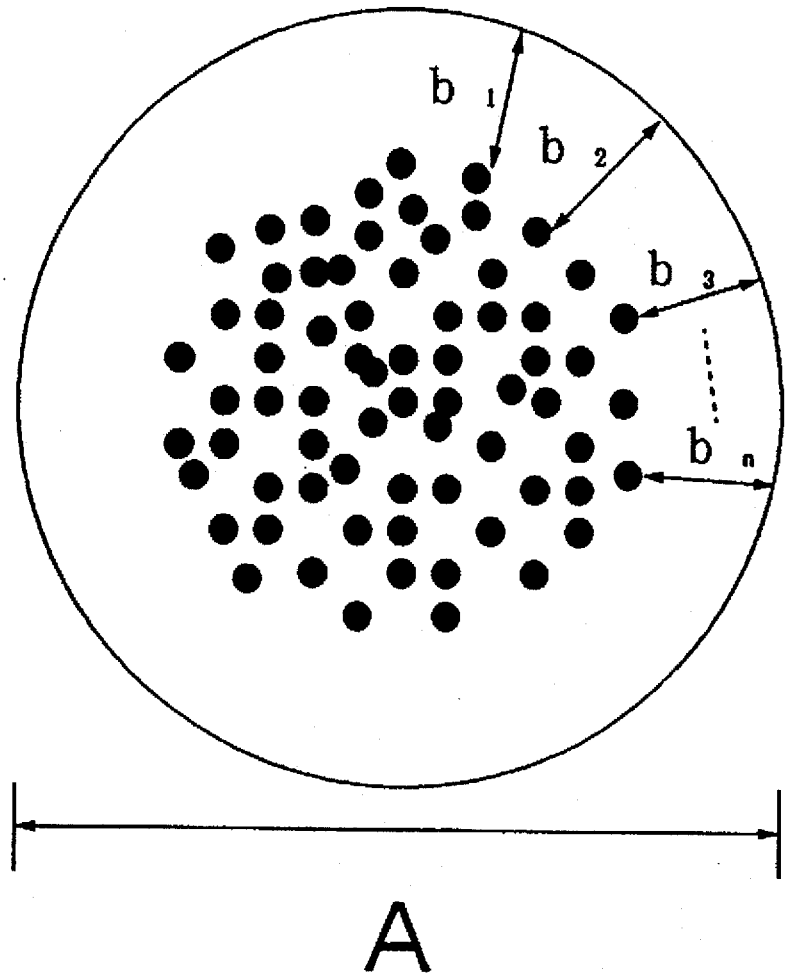
FIG. 1 is a schematic view for illustrating A and B ($b_1$, $b_2$, $b_3$, . . . $b_n$)

Element A in FIG. 1 is an average particle diameter of a toner; and elements $b_1$, $b_2$, $b_3$, . . . $b_n$ each represents a distance between each of particulate magnetic materials which are present at peripheral positions among the groups of the particulate magnetic materials in the toner and the closest toner surface for the magnetic material.

DETAILED DESCRIPTION OF THE INVENTION

The toner for developing an electrostatic latent image of the present invention is characterized in that no particulate magnetic materials are present on the surface of the toner, and A and $b_{min}$ satisfy the relationship:

$$b_{min}/A>0.02,$$

where "A" represents an average particle diameter of the toner, and "$b_{min}$" represents a minimum distance between a particulate magnetic material located at a position closest to the surface of the toner and the toner surface. Further, in the toner of the present invention, it is preferable that A and B satisfy the relationship: 0.5>B/A>0.02, wherein "A" represents an average particle diameter of a toner, and "B" represents an average thickness of the peripheral portion containing no particulate magnetic materials.

More specifically, "A" represents an average particle diameter of a toner, which is calculated by averaging the values obtained by COULTER MULTISIZER (manufactured by Kabushiki Kaisha Nikkaki). Also, "B" is a value calculated by the method mentioned below using a microphotograph of a cross section of a toner by a transmission electron microscope.

First, a microphotograph of a toner is selected such that a Heywood diameter (HD) obtained by an image analyzer ("LUZEX 500," manufactured by Nihon Regulator Kabushiki Kaisha) from a microphotograph is substantially the same value (within ±10% discrepancies) as "A" measured by COULTER MULTISIZER.

Here, the HD is determined as follows: A cross-sectional area S of the toner, which may have a non-circular shape, is analyzed, and after that, the HD, a diameter of an assumed circle having an identical area with the cross-sectional area S, may be defined by the following equation:

$$HD=\sqrt{\frac{4}{\pi}\times S}$$

wherein S represents the cross-sectional area of the toner.

Thereafter, in the selected microphotograph of the toner, among the group of the particulate magnetic materials observed in the inner portion of the toner, the particulate magnetic materials located at the outer peripheral portion are targeted, and distances $b_n$ ($b_1$, $b_2$, $b_3$, . . . $b_n$) between each of these targeted particulate magnetic materials and the closest toner surface are measured on the microphotograph (see FIG. 1), provided that a line drawn for measuring the distance does not contact a portion in which a group of particulate magnetic materials are dispersed. Here, the distances are not measured from the center of the targeted particulate magnetic materials, but from the surface of the magnetic materials. Among distances $b_n$, $b_{min}$ refers to the minimum distance thereof. In the toner of the present invention, $b_{min}/A>0.02$. Next, "B" is calculated by the following equation:

$$B=(\Sigma b_n)/n,$$

wherein n represents the total number of the particulate magnetic materials measured, and $b_n$ represents a distance between each of the particulate magnetic materials and the closest toner surface.

In the present invention, "A" and "B" normally satisfy the relationship of 0.5>B/A>0.02, preferably 0.3>B/A>0.04, more preferably 0.2>B/A>0.05. When B/A is not more than 0.02, the fixing strength may be undesirably lowered and the low-temperature fixing ability may become poor. Here, "A" is normally in the range of from 5 to 10 μm, and "B" is normally in the range of from 0.1 to 5 μm.

Examples of the particulate magnetic materials in the present invention include ferrite, magnetite, ferromagnetic metals such as iron, cobalt, and nickel, or alloys thereof, and compounds containing these elements; alloys not containing any ferromagnetic element which become ferromagnetic by suitable thermal treatment, for example, so-called "Heusler alloys" containing manganese and copper such as a manganese-copper-aluminum alloy, and a manganese-copper-tin alloy; and chromium dioxide. A preference is given to ferrite and magnetite. In the present invention, these particulate magnetic materials can be used singly or in a combination of two or more kinds.

In the foregoing particulate magnetic materials, depending upon the types of toners, those subjected to a surface treatment may be suitably used from the viewpoint of well controlling the B/A values. For example, in the case of an encapsulated toner using a hydrophilic shell resin, hydrophobic particulate magnetic materials such as hydrophobically treated materials are suitably used, and thereby the B/A can be easily controlled.

The particulate magnetic materials have an average particle diameter of 0.01 to 0.4 μm. Also, the amount of the particulate magnetic materials for one-component developer is from about 20 to 120 parts by weight, preferably from 40 to 110 parts by weight, based on 100 parts by weight of the binder resin. And the amount for two-component developer is from about 0.5 to 50 parts by weight, preferably from 1 to 40 parts by weight, based on 100 parts by weight of the binder resin.

In the present invention, the particulate magnetic materials may have the function as a coloring agent, but the following carbon blacks can be further added as coloring agents in order to improve toning degree. Examples of the coloring agents include various carbon blacks which may be produced by a thermal black method, an acetylene black method, a channel black method, and a lamp black method, a grafted carbon black, in which the surface of carbon black is coated with a resin, and mixtures thereof. The additional coloring agents are usually used in an amount of about 1 to 15 parts by weight, based on 100 parts by weight of the binder resin.

In the toner of the present invention, since the positions of the particulate magnetic materials satisfy the relationship of B/A>0.02 as mentioned above, the portion containing no particulate magnetic materials and comprising the resins which have effects on the fixing ability of the toner is present in the vicinity of the surface of the toner. Particularly in the case of an encapsulated toner, at least a shell resin is present as a resin containing no particulate magnetic materials, and preferably a core material resin layer containing no particulate magnetic materials is further present in the inner portion of the shell, the core material resin layer contacting the shell. Therefore, the fixing ability of the toner is remarkably improved compared with the toner obtained by conventional kneading methods wherein the particulate magnetic materials are located even on the surface thereof. Thus, the toner of the present invention has an excellent fixing ability.

The toner of the present invention may be an encapsulated toner, or it may be a polymerized toner having a non-encapsulated structure (hereinafter simply referring as "polymerized toner"). In the case where the toner of the present invention is an encapsulated toner, the encapsulated toner is produced by incorporating the particulate magnetic materials in the core-constituting material without adding any particulate magnetic materials in the shell-forming materials. In this case, B/A can be adjusted by suitably controlling the shell thickness. In the case where the toner of the present invention is a polymerized toner, the toner can be produced by a conventional method except that a polymer or oligomer, such as copolymer of styrene-maleic anhydride, which has a hydrophilic group and is soluble in a radical polymerization monomer, is added to a mixture comprising particulate magnetic materials and radical polymerization monomers while controlling the amount of the polymer or oligomer added.

Specifically, the toner of the present invention may be produced by a conventional dispersion polymerization method or by a dry method comprising stirring matrix particles used as a core material together with particles used as a shell-forming material having a number-average particle size of one-eighth or less of that of the matrix particles in an air stream at a high speed. A preference is given to a method utilizing a suspension polymerization.

First, each of the constituting materials of the toner will be explained below. The constituting materials for a polymerized toner are substantially the same as those for the core material of an encapsulated toner.

Specifically, examples of binder resins in the toner include thermoplastic resins, such as polyester resins, polyester-polyamide resins, polyamide resins, and vinyl resins, with a preference given to the vinyl resins. The glass transition temperatures ascribed to the thermoplastic resin mentioned above are preferably 40° C. to 70° C., but in cases where the encapsulated toners are used for the purpose of low-temperature fixing, the glass transition temperature of the core material is preferably 10° to 50° C., more preferably 20° C. to 45° C.

Among the above-mentioned thermoplastic resins, examples of the monomers of the vinyl resins include styrene and styrene derivatives such as styrene, o-methylstyrene, m-methylstyrene, p-methylstyrene, α-methylstyrene, p-ethylstyrene, 2,4-dimethylstyrene, p-chlorostyrene, and vinylnaphthalene; ethylenic unsaturated monoolefins such as ethylene, propylene, butylene, and isobutylene; vinyl esters such as vinyl chloride, vinyl bromide, vinyl fluoride, vinyl acetate, vinyl propionate, vinyl formate, and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, t-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate, and diethylaminoethyl methacrylate; substituted monomers of ethylenic monocarboxylic acids such as acrylonitrile, methacrylonitrile, and acrylamide; ethylenic dicarboxylic acids and substituted monomers thereof such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone.

Among the above binder resin components in the present invention, it is preferred that styrene or a styrene derivative is used in an amount of 50 to 90% by weight to form the main structure of the resins, and that an ethylenic monocarboxylic acid or esters thereof is used in an amount of 10 to 50% by weight in order to adjust the thermal properties such as the softening point of the resins, because the glass transition temperature of the resin can be easily controlled.

A crosslinking agent may be added, if necessary, to the monomers constituting the binder resin in the present invention. In such a case, any known crosslinking agents may be suitably used. Examples of crosslinking agents include any of the generally known crosslinking agents such as divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate, and diallyl phthalate. Among them, a preference is given to divinylbenzene and polyethylene glycol dimethacrylate. These crosslinking agents may be used alone or, if necessary, in a combination of two or more.

The amount of these crosslinking agents used is 0.001 to 15% by weight, preferably 0.1 to 10% by weight, based on the polymerizable monomers. In these ranges, the heat fixing ability or the heat-and-pressure fixing ability of the resulting toner is improved, and "offset phenomenon" wherein a part of the toner cannot be completely fixed on a paper but rather adheres to the surface of a heat roller, which in turn is transferred to a subsequent paper is inhibited.

A graft or crosslinked polymer prepared by polymerizing the above monomers in the presence of an unsaturated polyester may be also used as the binder resin.

Examples of the polymerization initiators to be used in the production of the binder resin include azo and diazo polymerization initiators such as 2,2'-azobis(2,4-dimethylvaleronitrile), 2,2'-azobisisobutyronitrile, 1,1'-azobis(cyclohexane-1-carbonitrile), and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide, and dicumyl peroxide.

For the purposes of controlling the molecular weight or molecular weight distribution of the polymer or controlling the reaction time, two or more polymerization initiators may be used in combination. The amount of the polymerization initiator used is 0.1 to 20 parts by weight, preferably 1 to 10 parts by weight, based on 100 parts by weight of the polymerizable monomers.

In the present invention, a charge control agent may be further added. The negative charge control agents are not particularly limited, and examples thereof include azo dyes containing metals such as "VARIFAST BLACK 3804" (manufactured by Orient Chemical Co., Ltd.), "BONTRON S-31" (manufactured by Orient Chemical Co., Ltd.), "BONTRON S-32" (manufactured by Orient Chemical Co., Ltd.), "BONTRON S-34" (manufactured by Orient Chemical Co., Ltd.), and "AIZEN SPILON BLACK TRH" (manufactured by Hodogaya Chemical Co., Ltd.); copper phthalocyanine dye; metal complexes of alkyl derivatives of salicylic acid such as "BONTRON E-81" (manufactured by Orient Chemical Co., Ltd.), "BONTRON E-82" (manufactured by Orient Chemical Co., Ltd.), and "BONTRON E-85" (manufactured by Orient Chemical Co., Ltd.); quaternary ammonium salts such as "COPY CHARGE NX VP434" (manufactured by Hoechst); and nitroimidazole derivatives.

The positive charge control agents are not particularly limited, and examples thereof include nigrosine dyes such as "NIGROSINE BASE EX" (manufactured by Orient Chemical Co., Ltd.), "OIL BLACK BS" (manufactured by Orient Chemical Co., Ltd.), "OIL BLACK SO" (manufactured by Orient Chemical Co., Ltd.), "BONTRON N-01" (manufactured by Orient Chemical Co., Ltd.), "BONTRON N-07" (manufactured by Orient Chemical Co., Ltd.), "BONTRON N-09" (manufactured by Orient Chemical Co., Ltd.), and "BONTRON N-11" (manufactured by Orient Chemical Co., Ltd.); triphenylmethane dyes containing tertiary amines as side chains; quaternary ammonium salt compounds such as "BONTRON P-51" (manufactured by Orient Chemical Co., Ltd.), cetyltrimethylammonium bromide, and "COPY CHARGE PX VP435" (manufactured by Hoechst); polyamine resins such as "AFP-B" (manufactured by Orient Chemical Co., Ltd.); and imidazole derivatives.

The above charge control agent may be optionally contained in the binder resin in an amount of 0.1 to 8.0% by weight, preferably 0.2 to 5.0% by weight.

If necessary, the toner may contain one or more suitable offset inhibitors for the purpose of improving the offset resistance in heat-and-pressure fixing, and examples of the offset inhibitors include polyolefins, metal salts of fatty acids, fatty acid esters, partially saponified fatty acid esters, higher fatty acids, higher alcohols, paraffin waxes, amide waxes, polyhydric alcohol esters, silicone varnishes, aliphatic fluorocarbons, and silicone oils.

Examples of the above polyolefins include resins such as polypropylene, polyethylene, and polybutene, which have softening points of 80° to 160° C. Examples of the above metal salts of fatty acids include metal salts of maleic acid with zinc, magnesium, and calcium; metal salts of stearic acid with zinc, cadmium, barium, lead, iron, nickel, cobalt, copper, aluminum, and magnesium; dibasic lead stearate; metal salts of oleic acid with zinc, magnesium, iron, cobalt, copper, lead, and calcium; metal salts of palmitic acid with aluminum and calcium; caprylates; lead caproate; metal salts of linoleic acid with zinc and cobalt; calcium ricinoleate; metal salts of ricinoleic acid with zinc and cadmium; and mixtures thereof. Examples of the above fatty acid esters include ethyl maleate, butyl maleate, methyl stearate, butyl stearate, cetyl palmitate, and ethylene glycol montanate. Examples of the above partially saponified fatty acid esters include montanic acid esters partially saponified with calcium. Examples of the above higher fatty acids include dodecanoic acid, lauric acid, myristic acid, palmitic acid, stearic acid, oleic acid, linoleic acid, ricinoleic acid, arachic acid, behenic acid, lignoceric acid, and selacholeic acid, and mixtures thereof. Examples of the above higher alcohols include dodecyl alcohol, lauryl alcohol, myristyl alcohol, palmityl alcohol, stearyl alcohol, arachyl alcohol, and behenyl alcohol. Examples of the above paraffin waxes include natural paraffins, microcrystalline waxes, synthetic paraffins, and chlorinated hydrocarbons. Examples of the above amide waxes include stearamide, oleamide, palmitamide, lauramide, behenamide, methylenebisstearamide, ethylenebisstearamide, N,N'-m-xylylenebisstearamide, N,N'-m-xylylenebis-12-hydroxystearamide, N,N'-isophthalic bisstearylamide, and N,N'-isophthalic bis-12-hydroxystearylamide. Examples of the above polyhydric alcohol esters include glycerol stearate, glycerol ricinolate, glycerol monobehenate, sorbitan monostearate, propylene glycol monostearate, and sorbitan trioleate. Examples of the above silicone varnishes include methylsilicone varnish and phenylsilicone varnish. Examples of the above aliphatic fluorocarbons include low polymerized compounds of tetrafluoroethylene and hexafluoropropylene, and fluorinated surfactants disclosed in Japanese Patent Laid-Open No. 53-124428. Among the above offset inhibitors, a preference is given to the polyolefins, with a particular preference to polypropylene.

It is preferable to use the offset inhibitors in an amount of 1 to 20% by weight, based on the binder resin.

In the case where the toner of the present invention is an encapsulated toner, a shell is formed on the outer surface of the core material, the shell-forming materials varying as explained below depending upon the methods of producing encapsulated toners.

Among them, in the case where the encapsulated toner is produced by spray drying method or dry encapsulation method, the shell-forming materials are not particularly limited.

In the case where the encapsulated toner is produced by in situ polymerization, the shell-forming resins are not particularly limited, as long as they have higher hydrophilicity than the monomers used for forming the core material.

In a typical example of in situ method in the present invention, the method comprises the steps of:

(a) dissolving a shell-forming resin in a mixture comprising a core material-constituting monomer, particulate magnetic materials, and other additives to give a polymerizable composition;

(b) dispersing the polymerizable composition obtained in step (a) in an aqueous dispersant, and localizing the shell-forming resin on the surface of droplets of the core-constituting material; and (c) polymerizing the polymerizable composition obtained in step (b) to form the core material covered with the shell.

Examples of the shell-forming resins include polyesters; polyesteramides; polyamides; polyureas; polymers of nitrogen-containing monomers, such as dimethylaminoethyl methacrylate and diethylaminoethyl methacrylate; copolymers of the above monomers and styrene or unsaturated carboxylic acid esters; polymers of unsaturated carboxylic acids such as methacrylic acid and acrylic acid, unsaturated dibasic acids, or unsaturated dibasic acid anhydrides; and copolymers of the above monomers and styrene-type monomers. Among the shell-forming resins, an amorphous polyester is suitably used as a main component thereof in the present invention, because the resulting toner has excellent low-temperature fixing ability, etc.

The amorphous polyester in the present invention can be usually obtained by a condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher polycarboxylic acid monomers. Among them, the amorphous polyesters obtained by the condensation polymerization of monomers containing at least one dihydric alcohol monomer and at least one dicarboxylic acid monomer, and further containing a trihydric or higher polyhydric alcohol monomer and/or a tricarboxylic or higher polycarboxylic acid monomer are suitably used.

The amorphous polyester described above can be contained in an amount of normally 50 to 100% by weight, based on the total weight of the shell, and the other components which may be contained in the shell include polyamides, polyester-amides, and polyurea resins in an amount of 0 to 50% by weight.

Examples of the dihydric alcohol monomers include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, propylene adducts of bisphenol A, ethylene adducts of bisphenol A, hydrogenated bisphenol A, and other dihydric alcohol monomers.

Examples of the trihydric or higher polyhydric alcohol monomers include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohol monomers. Among the alcohol monomers, the trihydric alcohol monomers are preferably used.

In the present invention, these dihydric alcohol monomers and trihydric or higher polyhydric alcohol monomers may be used singly or in combination.

As for the acid components, examples of the dicarboxylic acid monomers include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, n-dodecylsuccinic acid, n-octylsuccinic acid, isooctenylsuccinic acid, isooctylsuccinic acid, acid anhydrides thereof, lower alkyl esters thereof, and other dicarboxylic acid components.

Examples of the tricarboxylic or higher polycarboxylic acid monomers include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, acid anhydrides thereof, lower alkyl esters thereof, and other tricarboxylic or higher polycarboxylic acid components. In the present invention, among these carboxylic acid components, a preference is given to the tricarboxylic acids or derivatives thereof.

In the present invention, these dicarboxylic acid monomers and tricarboxylic or higher polycarboxylic acid monomers may be used singly or in combination.

The method for producing an amorphous polyester in the present invention is not particularly limited, and the amorphous polyester can be produced by esterification or transesterification of the above monomers.

Here, "amorphous" refers to those which do not have a definite melting point. When a crystalline polyester is used in the present invention, the amount of energy required for fusion is large, and thereby the fixing ability of the toner becomes undesirably poor.

The glass transition temperature of the amorphous polyester thus obtained is preferably 50° to 80° C., more preferably 55° to 75° C., from the viewpoints of the storage stability and the fixing ability of the resulting toner. In the present invention, the "glass transition temperature" used herein refers to the temperature of an intersection of the extension of the baseline of not more than the glass transition temperature and the tangential line showing the maximum inclination between the kickoff of the peak and the top thereof as determined using a differential scanning calorimeter ("DSC MODEL 210," manufactured by Seiko Instruments, Inc.), at a temperature rise rate of 10° C./min.

The acid value of the above amorphous polyester is preferably 3 to 50 KOH mg/g, more preferably 10 to 30 KOH mg/g from the viewpoints of the storage stability of the resulting toner and the production stability. Here, the acid value is measured by the method according to JIS K0070.

In the present invention, the amount of the above shell resins is normally 3 to 50 parts by weight, preferably 5 to 40 parts by weight, based on 100 parts by weight of the core material from the viewpoint of the fixing ability of the obtained toner.

In cases of producing a toner by suspension polymerization or in situ polymerization, a dispersion stabilizer has to be added to the dispersion medium in order to prevent aggregation and incorporation of the dispersed substances.

Examples of the dispersion stabilizers include gelatin, gelatin derivatives, polyvinyl alcohol, polystyrenesulfonic acid, hydroxymethylcellulose, hydroxyethylcellulose, hydroxypropylcellulose, sodium carboxymethylcellulose, sodium polyacrylate, sodium dodecylbenzenesulfonate, sodium tetradecyl sulfate, sodium pentadecyl sulfate, sodium octyl sulfate, sodium allyl alkyl polyethersulfonate, sodium oleate, sodium laurate, sodium caprate, sodium caprylate, sodium caproate, potassium stearate, calcium oleate, sodium 3,3-disulfonediphenylurea-4,4-diazobisamino-β-naphthol-6-sulfonate, o-carboxybenzeneazodimethylaniline, sodium 2,2,5,5-tetramethyltriphenylmethane-4,4-diazobis-β-naphtholdisulfonate, colloidal silica, alumina, tricalcium phosphate, ferrous hydroxide, titanium hydroxide, and aluminum hydroxide, with a preference given to tricalcium phosphate. These dispersion stabilizers may be used alone or in combination of two or more.

Examples of the dispersion media include water, methanol, ethanol, propanol, butanol, ethylene glycol, glycerol, acetonitrile, acetone, isopropyl ether, tetrahydrofuran, and dioxane, among which water is preferably used as an essential component. These dispersion media can be used singly or in combination.

In the present invention, the encapsulated toner produced by in situ polymerization may be used as precursor particles, and seed polymerization may be further conducted to give an encapsulated toner.

The seed polymerization in the present invention comprises the steps of adding at least a vinyl polymerizable monomer and an initiator for vinyl polymerization to an aqueous suspension of the encapsulated toner produced by in situ polymerization method (hereinafter which may be simply referred to as "precursor particles") to absorb them into the precursor particles; and polymerizing the monomer components in the above precursor particles.

For instance, when the precursor particles are produced by in situ polymerization method described above, at least a vinyl polymerizable monomer and an initiator for vinyl polymerization are immediately added to the precursor particles in a suspended state, and the monomer and the initiator are absorbed into the precursor particles, so that seed polymerization takes place with the monomer components absorbed in the precursor particles. By this method, the production steps can be simplified. The vinyl polymerizable monomers, etc. which are added to be absorbed into the precursor particles may be used in a state of an aqueous emulsion.

The aqueous emulsion to be added can be obtained by emulsifying and dispersing the vinyl polymerizable monomer and the initiator for vinyl polymerization in water together with a dispersion stabilizer, which may further contain other additives such as a crosslinking agent, an offset inhibitor and a charge control agent.

The vinyl polymerizable monomers used in the seed polymerization may be the same ones as those used for the production of the precursor particles. Also, the initiators for vinyl polymerization, the crosslinking agents and the dispersion stabilizers may also be the same ones as those used for the production of the precursor particles. The amount of the crosslinking agent used in the seed polymerization is preferably 0.001 to 15% by weight, more preferably 0.1 to 10% by weight, based on the vinyl polymerizable monomers.

In order to further improve the storage stability of the toner, hydrophilic shell-forming materials such as the amorphous polyester described above may be added to the aqueous emulsion. In this case, the amount of the shell-forming material added is normally 1 to 20 parts by weight, preferably 3 to 15 parts by weight, based on 100 parts by weight of the core material.

The acid value of the amorphous polyester used in the seed polymerization, as in the case of that used in in situ polymerization reaction, is preferably 3 to 50 KOH mg/g, more preferably 10 to 30 KOH mg/g.

The amount of the aqueous emulsion added is adjusted so that the amount of the vinyl polymerizable monomer used is 10 to 200 parts by weight, based on 100 parts by weight of the precursor particles from the viewpoints of the fixing ability of the resulting toner and uniform absorption of the monomer components in the precursor particles.

By adding the aqueous emulsion thereto, the vinyl polymerizable monomer is absorbed into the precursor particles so that the swelling of the precursor particles takes place. In the seed polymerization reaction, the monomer components in the precursor particles are polymerized in the above state. This polymerization may be referred to as "seed polymerization," wherein the precursor particles are used as seed particles.

In the present invention, in the case where the toner is a polymerized toner, the toner can be produced by using a polymer or oligomer which has a hydrophilic group and is soluble in a radical polymerization monomer, and adding it to a mixture comprising particulate magnetic materials and radical polymerization monomers while controlling the amount of the polymer or oligomer added.

Specifically, the toner is produced by the method comprising:

adding a polymer or oligomer having a hydrophilic group and being soluble in a radical polymerization monomer to a mixture comprising particulate magnetic materials and the radical polymerization monomers, to give a polymerizable composition; and polymerizing the polymerizable composition by suspension polymerization.

Here, the polymers or oligomers used in the present invention may be the copolymers having one or more acid anhydride groups. Examples thereof include a copolymer obtained by copolymerizing an α,β-ethylenic copolymerizable monomer (a) having an acid anhydride group and the other α,β-ethylenic copolymerizable monomer (b).

Here, examples of the α,β-ethylenic copolymerizable monomers (a) having an acid anhydride group include itaconic anhydride, crotonic anhydride, and the compounds represented by the following formula:

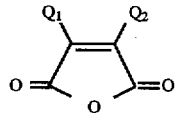

wherein $Q_1$ and $Q_2$ independently represents a hydrogen atom, an alkyl group having 1 to 3 carbon atoms or a halogen atom, which may be exemplified by maleic anhydride, citraconic anhydride, 2,3-dimethylmaleic anhydride, chloromaleic anhydride, and bromomaleic anhydride, with a preference given to maleic anhydride and citraconic anhydride.

Examples of other α,β-ethylenic copolymerizable monomers (b) include the above-mentioned monomers of vinyl resins.

The amount of the polymer or oligomer is normally from 2 to 100 parts by weight, preferably from 5 to 50 parts by weight, based on 100 parts by weight of the radical polymerization monomers, from the viewpoint of inhibiting the inclusion of the particulate magnetic materials on the peripheral portion of the toner.

The radical polymerization monomers are exemplified by the monomers for binder resins in the present invention.

In the toner for developing an electrostatic latent image of the present invention, a fluidity improver, or a cleanability improver may be used, if necessary. Examples of the fluidity improvers include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride, with a preference given to finely powdered silica.

The finely powdered silica is a fine powder having Si—O—Si linkages, which may be prepared by either the dry process or the wet process. The finely powdered silica may be not only anhydrous silicon dioxide but also any one of aluminum silicate, sodium silicate, potassium silicate, magnesium silicate and zinc silicate, with a preference given to those containing not less than 85% by weight of $SiO_2$. Further, finely powdered silica surface-treated with a silane coupling agent, a titanium coupling agent, silicone oil, and silicone oil having amine in the side chain thereof can be used.

The cleanability improvers include fine powders of metal salts of higher fatty acids typically exemplified by zinc stearate or fluorocarbon polymers.

Further, for the purpose of controlling the developability of the encapsulated toner, finely powdered polymers of methyl methacrylate or butyl methacrylate may be added.

The toner for developing an electrostatic latent image of the present invention may be used alone as a magnetic one-component developer, or as an alternative, it may be mixed with a carrier to give a two-component developer. Although the carrier is not particularly limited, examples thereof include iron powder, ferrite, glass beads, those of above with resin coatings, and resin carriers in which magnetite fine powders or ferrite fine powders are blended into the resins. The mixing ratio of the toner to the carrier is 0.5 to 20% by weight. The particle diameter of the carrier is 15 to 500 μm.

When the toner for developing an electrostatic latent image of the present invention is fixed on a recording medium such as paper by heat and pressure, an excellent fixing strength is attained. As for the heat-and-pressure fixing process to be suitably used in the fixing of the toner of the present invention, any one may be used as long as both heat and pressure are utilized. Examples of the fixing processes which can be suitably used in the present invention include a known heat roller fixing process; a fixing process as disclosed in Japanese Patent Laid Open No. 2-190870 in which visible images formed on a recording medium in an unfixed state are fixed by heating and fusing the visible images through the heat-resistant sheet with a heating means, comprising a heating portion and a heat-resistant sheet, thereby fixing the visible images onto the recording medium; and a heat-and-pressure process as disclosed in Japanese Patent Laid-Open No. 2-162356 in which the formed visible images are fixed on a recording medium through a film by using a heating element fixed to a support and a pressing member arranged opposite to the heating element in contact therewith under pressure.

EXAMPLES

The present invention is hereinafter described in more detail by means of the following resin production example, examples, comparative examples, and test example, but the present invention is not limited by these examples.

Resin Production Example 369.5 g of a propylene oxide adduct of bisphenol A (hereinafter abbreviated as "BPA•PO," average adduct molar number: 3), 146.4 g of an ethylene oxide adduct of bisphenol A (hereinafter abbreviated as "BPA•EO"), 126.0 g of terephthalic acid (hereinafter abbreviated as "TPA"), 40.2 g of dodecenyl succinic anhydride (hereinafter abbreviated as "DSA"), and 77.7 g of trimellitic anhydride (hereinafter abbreviated as "TMA") are placed in a two-liter four-necked glass flask equipped with a thermometer, a stainless steel stirring rod, a reflux condenser, and a nitrogen inlet tube, and allowed to react with one another at 220° C. in a mantle heater under a nitrogen gas stream while stirring.

The degree of polymerization is monitored from a softening point measured according to ASTM E 28-67, and the reaction is terminated when the softening point reaches 110° C. This resin is referred to as "Resin A."

The similar procedures to above are carried out to produce Resin B. The composition used are shown in Table 1.

Also, the glass transition temperature of each of the resins obtained is measured by the differential scanning calorimeter ("DSC Model 220," manufactured by Seiko Instruments, Inc.), and its value is shown together with the softening point and the acid value in Table 2. The acid value is measured by the method according to JIS K0070.

TABLE 1

| | Monomer (molar ratio) | | | | |
|---|---|---|---|---|---|
| Resin | BPA · PO | BPA · EO | TPA | DSA | TMA |
| A | 70 | 3C | 50 | 10 | 27 |
| B | 100 | — | 55 | 40 | — |

TABLE 2

| Resin | Softening Point (°C.) | Glass Transition Temperature (°C.) | Acid Value (KOH mg/g) |
|---|---|---|---|
| A | 110 | 65 | 18 |
| B | 110 | 63 | 10 |

Example 1

10.0 parts by weight of Resin A and 3.5 parts by weight of 2,2'-azobisisobutyronitrile are added to a mixture comprising 65.0 parts by weight of styrene, 35.0 parts by weight of 2-ethylhexyl acrylate, 0.8 parts by weight of divinylbenzene, and 98.0 parts by weight of triiron tetroxide ("M-0902," manufactured by Mitsui Mining & Smelting Co., Ltd., $\sigma s$=93.9 emu/g (5 kOe), $\sigma r$=7.7 emu/g (5 kOe), Hc=76 Oe (5 kOe), pH=7.5, and oil-absorbing capacity: 21 ml/100 g). The obtained mixture is introduced into an attritor ("Model MA-01SC," manufactured by Mitsui Miike Kakoki) and dispersed at 10° C. for 5 hours to give a polymerizable composition.

Next, 212.3 g of the above polymerizable composition is added to 650 g of a 4% by weight aqueous colloidal solution of tricalcium phosphate which is previously prepared in a two-liter separable glass flask. The obtained mixture is emulsified and dispersed with "T.K. HOMO MIXER, Model M" (manufactured by Tokushu Kika Kogyo) at room temperature and a rotational speed of 10000 rpm for 2 minutes.

Next, a four-necked glass cap is set on the flask, and a reflux condenser, a thermometer, a nitrogen inlet tube, and a stainless steel stirring rod are attached thereto. The flask is placed in an electric mantle heater. Thereafter, as a first-step reaction, the contents are heated to 85° C. and allowed to react with one another at 85° C. for 10 hours in a nitrogen atmosphere while stirring to give seed particles. The seed particles are cooled to room temperature to give precursor particles.

Next, 40.7 parts by weight of an aqueous emulsion comprising 13.0 parts by weight of styrene, 7.0 parts by weight of 2-ethylhexyl acrylate, 0.4 parts by weight of 2,2'-azobisisobutyronitrile, 0.22 parts by weight of divinylbenzene, 0.1 parts by weight of sodium laurylsulfate, and 20 parts by weight of water is added dropwise to an aqueous suspension containing the above precursor particles, the emulsion being prepared by a ultrasonic vibrator ("US-150," manufactured by Nippon Seiki Co., Ltd.), so that the precursor particles are swelled thereby. Immediately after the dropwise addition, when the emulsion is observed using an optical microscope, no emulsified droplets are found, confirming that swelling is finished in a remarkably short period of time. Thereafter, as a second-step polymerization, the contents are heated to 85° C. and allowed to react with one another at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner according to the present invention. This toner is referred to as "Toner 1."

The glass transition temperature ascribed to the resin contained in the core material is 26.5° C., and the softening point of Toner 1 is 115.2° C.

Figure 2:
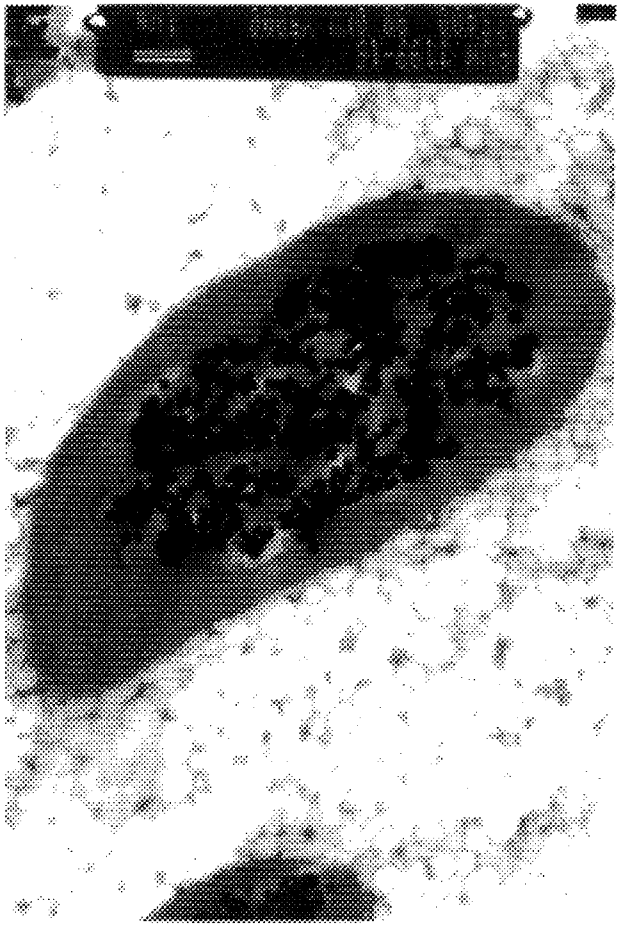
FIG. 2 is a microphotograph of a cross section of Toner 1 obtained in Example 1 by a transmission electron microscope.

Toner 1 is sliced using a microtome to give ultrathin slices. The obtained slices observed using a TEM (transmission electron microscope) (magnification: 5000 times) are shown in FIG. 2. As is calculated from FIG. 2, the average value of B/A is 0.12, and $b_{min}$/A is 0.04. Also, the HD value is 7.8 μm. Moreover, no particulate magnetic materials are found to be present on the toner surface.

Example 2

15.0 parts by weight of Resin B and 5.0 parts by weight of 2,2'-azobis(2-methylbutyronitrile) are added to a mixture comprising 69.0 parts by weight of styrene, 31.0 parts by weight of 2-ethylhexyl acrylate, 0.9 parts by weight of divinylbenzene, 10.0 parts by weight of styrene-grafted carbon black "GP-E-3" (manufactured by Ryoyu Kogyo), and 98.0 parts by weight of triiron tetroxide ("M-0902," manufactured by Mitsui Mining & Smelting Co., Ltd.). The obtained mixture is introduced into an attritor ("Model MA-01SC," manufactured by Mitsui Miike Kakoki) and dispersed at 10° C. for 5 hours to give a polymerizable composition.

Next, 228.9 g of the above polymerizable composition is added to 650 g of a 4% by weight aqueous colloidal solution of tricalcium phosphate which is previously prepared in a two-liter separable glass flask. The obtained mixture is emulsified and dispersed with "T.K. HOMO MIXER, Model M" (manufactured by Tokushu Kika Kogyo) and a rotational speed of 10000 rpm for 2 minutes.

Next, a four-necked glass cap is set on the flask, and a reflux condenser, a thermometer, a nitrogen inlet tube, and a stainless steel stirring rod are attached thereto. The flask is placed in an electric mantle heater. Thereafter, as a first-step reaction, the contents are heated to 80° C. and allowed to react with one another at 80° C. for 10 hours in a nitrogen atmosphere while stirring to give seed particles. The seed particles are cooled to room temperature to give precursor particles.

Next, 71.7 parts by weight of an aqueous emulsion comprising 21.0 parts by weight of styrene, 4.0 parts by weight of 2-ethylhexyl acrylate, 1.2 parts by weight of 2,2'-azobisisobutyronitrile, 0.4 parts by weight of divinylbenzene, 5.0 parts by weight of Resin B, 0.1 parts by weight of sodium laurylsulfate, and 40 parts by weight of water is added dropwise to an aqueous suspension containing the above precursor particles, the emulsion being prepared by a ultrasonic vibrator ("US-150," manufactured by Nippon Seiki Co., Ltd.). Immediately after the dropwise addition, when the emulsion is observed using an optical microscope, no emulsified droplets are found, confirming that swelling is finished in a remarkably short period of time. Thereafter, as second-step polymerization, the contents are heated to 85° C. and allowed to react with one another at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner according to the present invention. This toner is referred to as "Toner 2."

The glass transition temperature ascribed to the resin contained in the core material is 28.7° C., and the softening point of Toner 2 is 114.0° C.

Toner 2 is sliced using a microtome to give ultrathin slices. As a result of observing the obtained slices using a TEM (transmission electron microscope), it is calculated that the average value of B/A is 0.1, and $b_{min}$/A is 0.04. Moreover, no particulate magnetic materials are found to be present on the toner surface.

Example 3

98.0 parts by weight of triiron tetroxide ("M-0902," manufactured by Mitsui Mining & Smelting Co., Ltd.) and 2.0 parts by weight of low-molecular weight polyethylene ("MITSUI HIWAX 1120H," manufactured by Mitsui Petrochemical Industries, Ltd.) are added to a mixture comprising 82.0 parts by weight of styrene, 18.0 parts by weight of 2-ethylhexyl acrylate, 1.0 parts by weight of divinylbenzene, 3.5 parts by weight of 2,2'-azobisisobutyronitrile, and 10 parts by weight of a copolymer obtained by copolymerizing styrene and maleic anhydride (molar ratio of styrene:maleic anhydride=3:1; molecular weight: 1900). The obtained mixture is introduced into an attritor ("Model MA-01SC," manufactured by Mitsui Miike Kakoki) and dispersed at 10° C. for 5 hours to give a polymerizable composition.

Next, 205.5 g of the above polymerizable composition is added to 560 g of a 4% by weight aqueous colloidal solution of tricalcium phosphate which is previously prepared in a two-liter separable glass flask. The obtained mixture is emulsified and dispersed with "T.K. HOMO MIXER, Model M" (manufactured by Tokushu Kika Kogyo) and a rotational speed of 10000 rpm for 2 minutes.

Next, a four-necked glass cap is set on the flask, and a reflux condenser, a thermometer, a nitrogen inlet tube, and a stainless steel stirring rod are attached thereto. The flask is placed in an electric mantle heater. Thereafter, the contents are allowed to react with one another at 80° C. for 6 hours in a nitrogen atmosphere while stirring.

After cooling the reaction product, the dispersing agent is dissolved into 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give a toner with an average particle size of 8 μm.

To 100 parts by weight of this encapsulated toner, 0.4 parts by weight of hydrophobic silica fine powder "Aerozil R-972" (manufactured by Nippon Aerozil Ltd.) is added and mixed to give a toner according to the present invention. This toner is referred to as "Toner 3."

The glass transition temperature ascribed to Toner 3 is 58.0° C., and the softening point of Toner 3 is 120.5° C.

Toner 3 is sliced using a microtome to give ultrathin slices. As a result of observing the obtained slices using a TEM (transmission electron microscope), it is calculated that the average value of B/A is 0.08, and $b_{min}/A$ is 0.03. Moreover, no particulate magnetic materials are found to be present on the toner surface.

Comparative Example 1

88.0 parts by weight of a copolymer obtained by copolymerizing styrene, 2-ethylhexyl acrylate, and divinylbenzene (softening point: 133.0° C., and glass transition temperature: 61.9° C.), 65.0 parts by weight of triiron tetroxide ("M-0902," manufactured by Mitsui Mining & Smelting Co., Ltd.), 2.0 parts by weight of a negative charge control agent "T-77," manufactured by Hodogaya Chemical Co., Ltd.), and 2.0 parts by weight of a wax ("VISCOL TS-200," manufactured by Sanyo Chemical Industries, Ltd.) are blended well using a Henshel mixer, and the mixture is kneaded, cooled and roughly pulverized using a twin-screw extruder equipped with a Barrel cooling system under the conditions of a set Barrel temperature of 100° C., a screw rotational speed of 195 rpm, and a starting material feeding rate of 7 kg/hour. Thereafter, the obtained roughly pulverized product is finely pulverized using a jet mill, and then further classified using an air classifier, to give fine particles with an average particle size of 6 μm.

To 100 parts by weight of this toner, 0.4 parts by weight of hydrophobic silica fine powder "Aerozil R-972" (manufactured by Nippon Aerozil Ltd.) is added and mixed to give a comparative toner. This toner is referred to as "Comparative Toner 1."

The glass transition temperature ascribed to Comparative Toner 1 is 63.1° C., and the softening point of Comparative Toner 1 is 132.0° C.

Figure 3:
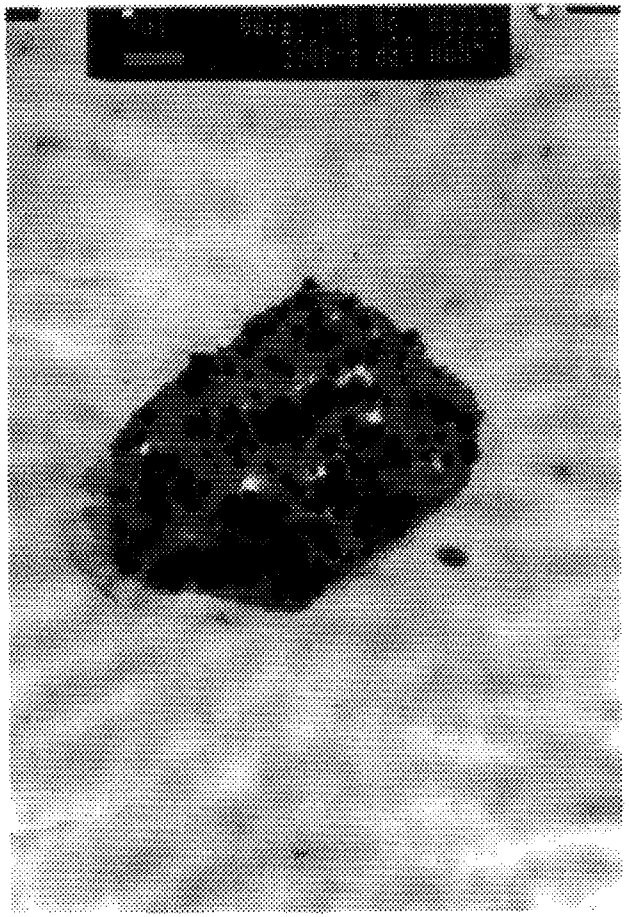
FIG. 3 is a microphotograph of a cross section of the comparative toner obtained in Comparative Example 1 by a transmission electron microscope.

Comparative Toner 1 is sliced using a microtome to give ultrathin slices. The obtained slices observed using a TEM (transmission electron microscope) (magnification: 5000 times) are shown in FIG. 3. As a result, particulate magnetic materials are found to be present even on the toner surface ($b_{min}/A$ is 0). Also, the HD value is 5.5 μm.

Comparative Example 2

40 parts by weight of Resin A, 50 parts by weight of magnetite "EPT1001" (manufactured by Toda Kogyo Kabushiki Kaisha) and 3.5 parts by weight of 2,2'-azobisisobutyronitrile are added to a mixture comprising 69.0 parts by weight of styrene, 31.0 parts by weight of 2-ethylhexyl acrylate, 0.9 parts by weight of divinylbenzene and 7.0 parts by weight of carbon black "#44" (manufactured by Mitsubishi Kasei Corporation). The obtained mixture is introduced into an attritor (Model MA-01SC, manufactured by Mitsui Miike Kakoki) and dispersed at 10° C. for 5 hours to give a polymerizable composition.

Next, 240 g of this polymerizable composition is added to 560 g of a 4% by weight aqueous colloidal solution of tricalcium phosphate which is previously prepared in a two-liter separable glass flask. The obtained mixture is emulsified and dispersed with "T.K. HOMO MIXER, Model M" (manufactured by Tokushu Kika Kogyo) at 5° C. and a rotational speed of 12000 rpm for 5 minutes.

Next, a four-necked glass cap is set on the flask, and a reflux condenser, a thermometer, a nitrogen inlet tube and a stainless steel stirring rod are attached thereto. The flask is placed in an electric mantle heater. Thereafter, the contents are heated to 85° C. and reacted at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, dried under a reduced pressure of 20 mmHg at 45° C. for 12 hours and classified with an air classifier to give a magnetic encapsulated toner with an average particle size of 7 μm whose shell comprises an amorphous polyester.

This toner is referred to as "Comparative Toner 2."

The glass transition temperature ascribed to Comparative Toner 2 is 33.0° C., and the softening point of Comparative Toner 2 is 133° C.

Figure 4:
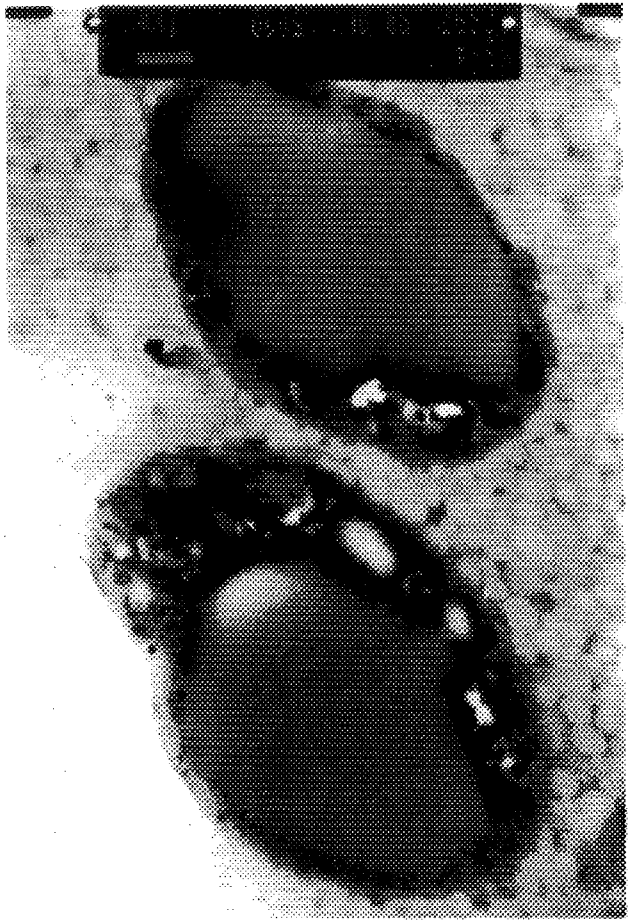
FIG. 4 is a microphotograph of a cross section of the comparative toner obtained in Comparative Example 2 by a transmission electron microscope.

Comparative Toner 2 is sliced using a microtome to give ultrathin slices. The obtained slices observed using a TEM (transmission electron microscope) (magnification: 5000 times) are shown in FIG. 4. As a result, particulate magnetic materials are found to be present even on the toner surface ($b_{min}/A$ is 0). Also, the HD value is 7.1 μm.

Test Example (1) Fixing ability

The fixing ability is evaluated by the method as described below. Specifically, each of Toners prepared as described above is used as a developer and loaded on a commercially available electrophotographic laser printer ("LASER SHOT B406S," manufactured by Canon Inc.) to develop unfixed images, and the fixing ability is evaluated using a fixing device having a processing speed of 160 mm/sec while varying temperature and an oil applying device being removed therefrom. Specifically, by controlling the fixing temperature from 70° C. to 220° C., the fixing ability of the formed images is evaluated. The results are shown in Table 3.

The lowest fixing temperature used herein is the temperature of the fixing roller at which the fixing ratio of the toner exceeds 70%. This fixing ratio of the toner is determined by placing a load of 500 g on a sand-containing rubber eraser (LION No. 502) having a bottom area of 15 mm×7.5 mm which contacts the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Process Measurements Co., and then calculating the fixing ratio from the density values before and after the eraser treatment using the following equation.

$$\text{Fixing ratio (\%)} = \frac{\text{Image density after eraser treatment}}{\text{Image density before eraser treatment}} \times 100$$

(2) Offset resistance

The offset resistance is evaluated by measuring the temperature of the low-temperature offset disappearance and the temperature of the high-temperature offset initiation. Specifically, copying tests are carried out by raising the temperature of the heat roller surface at an increment of 5° C. in the range from 70° C. to 220° C., and at each temperature, the adhesion of the toner onto the heat roller surface for fixing is evaluated with naked eye. The results are shown in Table 3.

(3) Blocking Resistance

The blocking resistance is determined by evaluating the extent of the generation of aggregation after the toner is kept standing under the conditions at a temperature of 50° C. and a relative humidity of 40% for 24 hours. The results are also shown in Table 3.

TABLE 3

| | Lowest Fixing Temp. (°C.) | Low-Temp. Offset Disappearing Temp. (°C.) | High-Temp. Offset Initiating Temp. (°C.) | Blocking Resistance |
|---|---|---|---|---|
| Toner 1 | 115 | 100 | 220 < | Good |
| Toner 2 | 118 | 105 | 180 | Good |
| Toner 3 | 130 | 115 | 220 < | Good |
| Comparative Toner 1 | 180 | 130 | 220 < | Good |
| Comparative Toner 2 | 126 | 115 | 220 < | Good |

As is clear from Table 3, Toners 1 to 3 of the present invention are fixable at a low temperature, so that high-quality images can be obtained. By contrast, Comparative Toner 1 is not fixable unless the temperature of the fixing roller is raised undesirably high. Also, as for Comparative Toner 2, although the toner has an encapsulated structure, since the particulate magnetic materials are present on the surface of the toner, it is not fixable unless the temperature of the fixing roller is raised higher than that of Toner 1 and 2 having an encapsulated structure.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for developing an electrostatic latent image, comprising at least particulate magnetic materials and a binder resin, the toner having no particulate magnetic materials on the surface of the toner, wherein A and $b_{min}$ satisfy the relationship:

$$b_{min}/A>0.02,$$

where A represents an average particle diameter of the toner, and $b_{min}$ represents a minimum distance between a particulate magnetic material located at a position closest to the surface of the toner and the toner surface, and wherein said toner is produced by the method comprising the steps of:

(a) dissolving a shell-forming resin in a mixture comprising a core material-constituting monomer, particulate magnetic materials, and other additives to give a polymerizable composition;

(b) dispersing the polymerizable composition obtained in step (a) in an aqueous dispersant, and localizing the shell-forming resin on the surface of droplets of a core-constituting material; and (c) polymerizing the polymerizable composition obtained in step (b) to form a core material covered with a shell.

2. The toner according to claim 1, further having the relationship:

$$0.5>B/A>0.02,$$

where A represents an average particle diameter of the toner, and B represents an average thickness of a peripheral portion containing no particulate magnetic materials.

3. The toner according to claim 2, wherein said relationship is 0.3>B/A>0.04.

4. The toner according to claim 2, wherein said relationship is 0.2>B/A>0.05.

5. The toner according to claim 1, wherein said particulate magnetic materials have an average particle diameter of from 0.01 to 0.4 μm.

6. The toner according to claim 2, wherein said A is from 5 to 10 μm, and said B is from 0.1 to 5 μm.

7. The toner according to claim 1, wherein the amount of said particulate magnetic materials is 20 to 120 parts by weight, based on 100 parts by weight of the binder resin.

8. The toner according to claim 1, wherein said toner is an encapsulated toner.

9. The toner according to claim 8, wherein said encapsulated toner contains a shell-forming resin comprising an amorphous polyester as a main component of the shell-forming resin.

10. The toner according to claim 8, wherein said particulate magnetic materials are incorporated in the core material and not incorporated in the shell.

11. A toner for developing an electrostatic latent image, comprising at least particulate magnetic materials and a binder resin, the toner having no particulate magnetic materials on the surface of the toner, wherein A and $b_{min}$ satisfy the relationship:

$$b_{min}/A>0.02,$$

where A represents an average particle diameter of the toner, and $b_{min}$ represents a minimum distance between a particulate magnetic material located at a position closest to the surface of the toner and the toner surface, and wherein said toner is produced by the method comprising:

adding a polymer or oligomer having a hydrophilic group and being soluble in a radical polymerization monomer to a mixture comprising particulate magnetic materials and the radical polymerization monomers, to give a polymerizable composition; and polymerizing the polymerizable composition by suspension polymerization.

12. A toner for developing an electrostatic latent image, comprising at least particulate magnetic materials and a binder resin, the toner having no particulate magnetic materials on the surface of the toner, wherein A and $b_{min}$ satisfy the relationship:

$$b_{min}/A>0.02,$$

where A represents an average particle diameter of the toner, and $b_{min}$ represents a minimum distance between a particulate magnetic material located at a position closest to the surface of the toner and the toner surface, and wherein said toner is produced by the method comprising the steps of:

(a) dissolving a shell-forming resin in a mixture comprising a core material-constituting monomer, particulate magnetic materials, and other additives to give a polymerizable composition;

(b) dispersing the polymerizable composition obtained in step (a) in an aqueous dispersant, and localizing the shell-forming resin on the surface of droplets of a core-constituting material;

(c) polymerizing the polymerizable composition obtained in step (b) to form precursor particles in which a core material is covered with a shell;

(d) adding at least a vinyl polymerizable monomer and an initiator for vinyl polymerization to an aqueous suspension of the precursor particles obtained in step (c) to absorb them into the precursor particles; and (e) polymerizing the monomer components in the precursor particles.

* * * * *